US007494569B2

(12) United States Patent
Liew et al.

(10) Patent No.: US 7,494,569 B2
(45) Date of Patent: Feb. 24, 2009

(54) APPARATUS FOR CLEANING A PAPERMACHINE FABRIC

(75) Inventors: Jiew Poh Liew, Perak (MY); Antony Morton, Ilkley (GB); Dwight Payne, St. Simons Island, GA (US); Craig Valentine, Summerville, SC (US)

(73) Assignee: Voith Paper Patent GmbH, Heidenheim (DE)

( * ) Notice: Subject to any disclaimer, the term of this patent is extended or adjusted under 35 U.S.C. 154(b) by 355 days.

(21) Appl. No.: 11/282,815

(22) Filed: Nov. 17, 2005

(65) Prior Publication Data

US 2006/0219377 A1 Oct. 5, 2006

(30) Foreign Application Priority Data

Nov. 22, 2004 (DE) ..... 10 2004 056 321

(51) Int. Cl.
*D21F 1/32* (2006.01)

(52) U.S. Cl. ..... 162/274; 162/272; 162/275; 162/199; 162/DIG. 4

(58) Field of Classification Search ..... 162/199, 162/274; 134/122 R, 15
See application file for complete search history.

(56) References Cited

U.S. PATENT DOCUMENTS 1,637,169 A * 7/1927 Youngchild ..... 162/274
1,846,646 A * 2/1932 Lansing ..... 162/278
1,880,687 A * 10/1932 Berry ..... 162/199
4,556,453 A * 12/1985 Meinecke ..... 162/274
5,946,766 A * 9/1999 Kitamura et al. ..... 15/256.5
2005/0194114 A1 * 9/2005 Weinstein et al. ..... 162/199

FOREIGN PATENT DOCUMENTS

| | | | |
|---|---|---|---|
| DE | 41 05 674 A1 | | 8/1992 |
| EP | 0 053 316 | * | 6/1982 |
| EP | 0 343 711 A | | 11/1989 |
| EP | 0 934 304 | * | 8/1999 |
| EP | 0 936 304 A | | 8/1999 |
| JP | 01 321990 | | 12/1989 |
| WO | WO 97/02380 | | 1/1997 |

OTHER PUBLICATIONS

European Search Report Nov. 28, 2005.

* cited by examiner

*Primary Examiner*—Eric Hug
(74) *Attorney, Agent, or Firm*—Taylor & Aust, P.C.

(57) ABSTRACT

An apparatus for cleaning a papermachine fabric has a device for removing contaminants from a fabric. The device has a contact surface which comes into contact with at least an outer side of the fabric and which is constructed and arranged in such a way that the contaminants can be transferred from the fabric to the contact surface. The apparatus is particularly useful in the cleaning of dryer fabrics having sticky or tacky contaminants in paper production.

10 Claims, 1 Drawing Sheet

APPARATUS FOR CLEANING A PAPERMACHINE FABRIC

CROSS-REFERENCE TO RELATED APPLICATIONS

The present application claims priority under 35 U.S.C. §119 of German Patent Application No. 10 2004 056 321.7 filed on Nov. 22, 2004, the disclosure of which is expressly incorporated by reference herein in its entirety.

BACKGROUND OF INVENTION

1. Field of the Invention

The invention relates to an apparatus for cleaning a papermachine fabric, in particular a dryer fabric having sticky contaminants.

2. Discussion of Background Information

An apparatus of the type mentioned at the beginning is known, for example from WO 97/02380. This apparatus, for cleaning a dryer fabric, has a device for removing contaminants from the dryer fabric in which water jets under high-pressure are applied to the dryer fabric transversely with respect to the running direction of the fabric. With the aid of these high-pressure water jets, contaminants are intended to be removed from the papermachine fabric. The disadvantage here is that the high-pressure water jets accelerate the degradation of the fabric and, to this extent, reduce the lifetime of the papermachine fabric. Usually, such cleaning of a papermachine fabric cannot be carried out during the operation of the paper machine because of the increased wetting of the fabric, i.e. the normal operation of the paper machine has to be interrupted in order to clean the papermachine fabric. This results in increased stoppage times. When the high-pressure water jets strike the outer side of the fabric, depending on the point at which they strike and the intensity with which they strike, it is possible for the case to occur in which the fabric cannot be cleaned completely of contaminants. This can result in more frequent cleaning times or, overall, longer stoppage times of the paper machine in order to clean the fabric. In order not to increase the level of moisture of the fabric as a result of the application of the high-pressure water jets, the presence of a drying device assigned to the fabric may also be necessary, resulting in increased expenditure.

SUMMARY OF THE INVENTION

The invention is based on the object of providing an apparatus for cleaning a papermachine fabric which can be handled more economically.

According to the invention, this object is achieved by an apparatus having the features of patent claim 1.

According to the invention, the device for removing the contaminants from the fabric has a contact surface which comes into contact with at least an outer side of the fabric and which is constructed and arranged in such a way that the contaminants can be transferred from the fabric to the contact surface. To this extent, a flat or at least linear contact between the at least one outer side of the fabric and the contact surface permits detachment of the contaminants from the fabric and transfer of the same to the contact surface. As a result of such a contact, the risk of wear of the fabric is reduced considerably as compared with an apparatus in which the contaminants are detached by means of high-pressure water jets. Since the contact surface itself does not have a high water content and, to this extent, can barely have a detrimental effect on the moisture content of the plate machine fabric, the cleaning operation can be carried out during the normal operation of the paper machine. This reduces stoppage times of the paper machine and increases the economy of the paper production. To this extent, specific drying devices for the fabric are not required. As a result of the flat or at least linear contact between fabric and contact surface, effective cleaning of the papermachine fabric can be achieved. With the aid of the device according to the invention having the contact surface, economic cleaning of a papermachine fabric is therefore possible, so that overall an improved machine efficiency can be achieved.

According to an advantageous development of the invention, the contact surface has an effective surface which is larger than that of the fabric, the contact surface preferably being present in the form of a woven fabric with a fibrous surface, in which the increase in the effective surface is brought about by a high slenderness ratio of the fibers. As a result of increasing the effective surface in the region of the contact surface as compared to that of the fabric, the supporting surface of the contaminant on the side of the contact surface is increased as compared with the side of the papermachine fabric. As a result, in particular sticky or tacky contaminants of the papermachine fabric can be transferred more easily to the contact surface. The respective contaminant therefore adheres to the contact surface rather than to the papermachine fabric when the two surfaces, namely at least one outer side of the fabric and the contact surface, come into contact. As a result, contaminants of the fabric can be detached very effectively from the latter and transferred to the contact surface.

According to a further preferred embodiment of the invention, the contact surface is produced from a material which is softer than the material from which the fabric is produced. Thus, the contact surface is softer than the fabric, which means that the detachment of contaminants from the fabric and the adhesion of the detached contaminants to the contact surface are improved.

According to another embodiment of the invention, the contact surface is constructed in the form of a circulating belt or in the form of a rotatable roll or drum. The circulating belt and the rotatable roll or drum can be provided with an individual drive or moved together with the papermachine fabric. Ultimately, it is very much more economic to replace the circulating belt or the roll or drum or their circumferential surface than the papermachine fabric and to replace it by a new belt or a new roll or drum or circumferential surface of the latter. To this extent, the contact surface according to the invention can also be designated a sacrificial contact surface (sacrificial surface).

The contact surface is advantageously treated chemically in order to facilitate and to accelerate the detachment process of the contaminants and the transfer of the same from the papermachine fabric to the contact surface.

According to another embodiment of the invention, the contact surface is assigned a cleaning device and, preferably, a drying device arranged downstream of the cleaning device in the direction of movement of the contact surface. The cleaning device and drying devices are used to detach the contaminants transferred from the papermachine fabric to the contact surface and to send the contaminants to a disposal system. Therefore, the period of use of the contact surface according to the invention is increased. The contact surface is then able to remove contaminants from the papermachine fabric for a longer period, which further improves the economy of use of the contact surface according to the invention.

The temperature in the contact region between the at least one outer side of the fabric and the contact surface is advantageously at least 50° C., preferably at least 80° C. Temperatures of this type improve the transfer in particular of sticky contaminants from the papermachine fabric to the contact surface and therefore also contribute to more economic handling of the entire apparatus.

According to a particularly preferred embodiment, the device for removing the contaminants from the fabric is constructed in such a way that the fabric and the contact surface are preferably pressed against each other in a nip in their contact region. The additional application of pressure between the papermachine fabric and the contact surface can further improve the efficiency of the transfer of contaminants to the contact surface, particularly economic operation of the apparatus with an elevated temperature and simultaneously increased contact pressure between fabric and contact surface being possible.

BRIEF DESCRIPTION OF THE DRAWINGS

Exemplary embodiments of the subject matter of the invention will be explained in more detail below using the drawings, all the features described and/or illustrated pictorially, on their own or in any desired combination, forming the subject matter of the present invention, irrespective of their combination in the claims or their back reference. In the drawings:

In FIGS. 1 and 2, an apparatus 1 for cleaning a papermachine fabric 2 is illustrated schematically in a side view in different embodiments.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
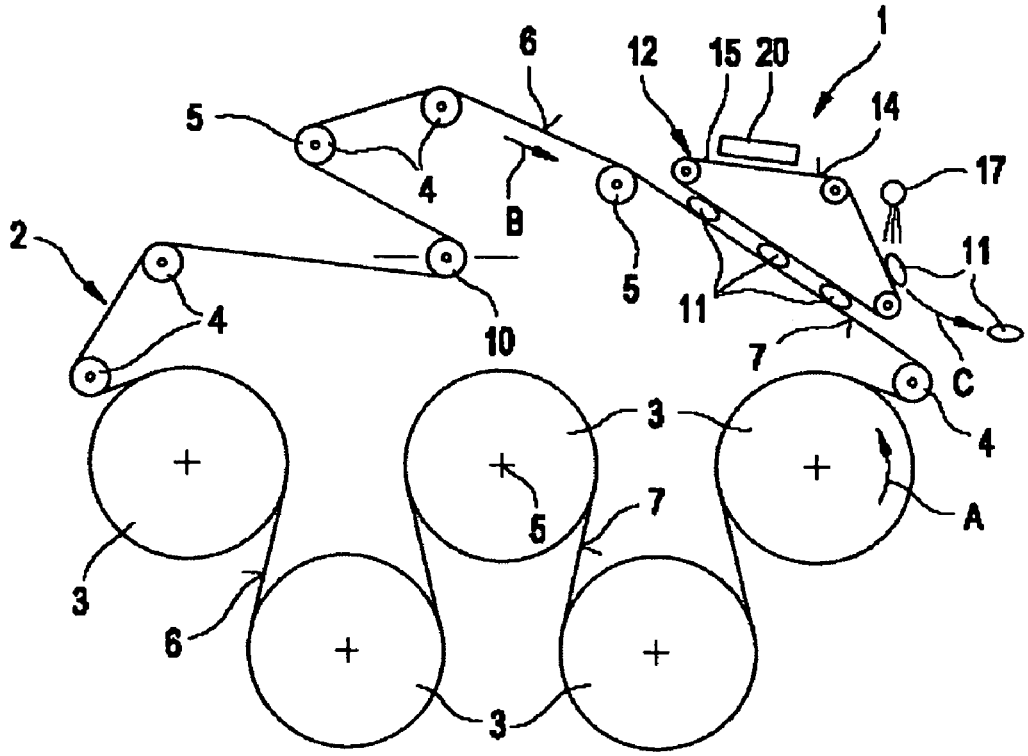
FIG. 1 is a schematic side view of an apparatus for cleaning a papermachine fabric according to a first embodiment.
Figure 2:
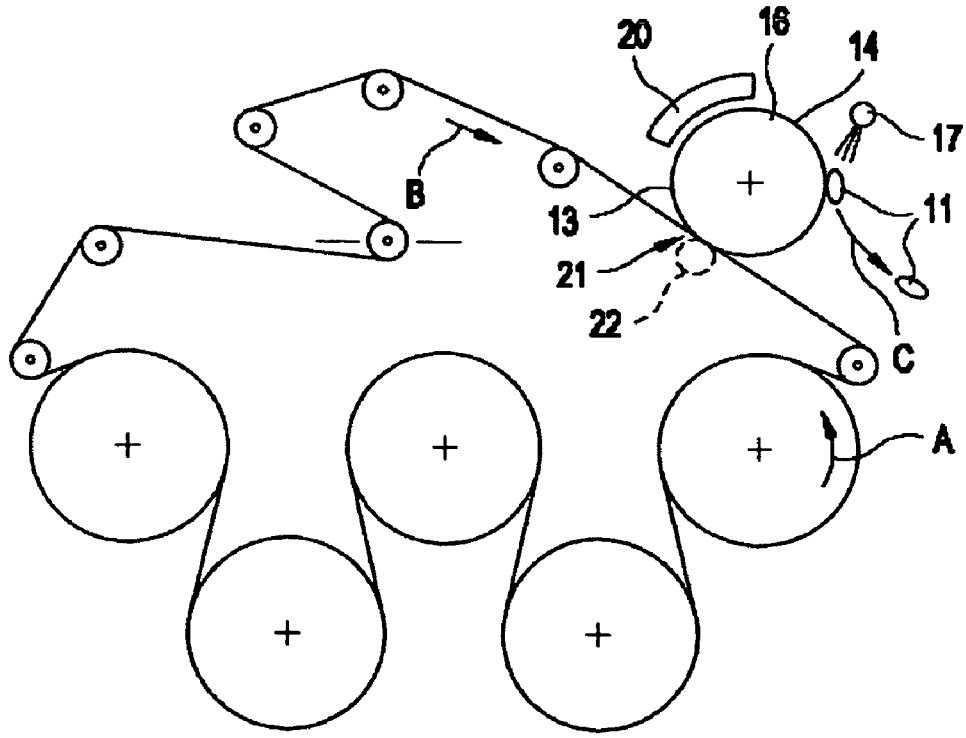
FIG. 2 is a schematic side view of an apparatus for cleaning a papermachine fabric according to a second embodiment.

The papermachine fabric 2 is led in meandering fashion around rolls or drums 3 of large diameter, of which, as shown in FIGS. 1 and 2, three upper rolls are arranged beside one another and spaced apart from one another and two lower rolls are arranged approximately to the interspace between two upper rolls in each case. Furthermore, the papermachine fabric 2 runs around a plurality of rolls 4 of small diameter, which are arranged substantially above the rolls 3 of large diameter. All the rolls 3, 4 are mounted such that they can rotate about their respective axis of rotation 5.

As shown in FIGS. 1 and 2, the papermachine fabric 2 is led in meandering fashion around the rolls 4 of large diameter in such a way that on one occasion the one outer side 6, namely the upper side, and on one occasion the other outer side 7, namely the underside, comes into contact with the circumferential surface of a roll. The respective axes of rotation 5 are normally kept in a fixed location. Only one of the rolls 4, namely the roll 10, having a small diameter can be displaced back and forth in the radial direction, for example in order to tension the papermachine fabric 2, and can be locked in the desired position. It is understood that at least one of the rolls 3, 4 is driven, so that the top right roll 3 of large diameter rotates in the direction of the arrow A, for example, and the papermachine fabric 2 is accordingly conveyed in the direction of the arrow B.

The apparatus 1 according to the invention is used for cleaning the papermachine fabric 2, in particular but not exclusively a dryer fabric having sticky contaminants 11. However, the papermachine fabric can also be a press felt, for example. Likewise, the contaminants 11 are merely preferably sticky contaminants, that is to say sticky or tacky contaminants. It is clear that the contamination 11 can ultimately also consist of further, i.e. non-sticky, constituents.

The contaminants 11 are indicated in FIG. 1 only on one outer side 6, namely the upper side of the papermachine fabric 2 and then, for improved clarity, only in the region of the apparatus 1.

The apparatus 1 has a device 12 for removing the contaminants 11 from the papermachine fabric 2, referred to briefly below as the fabric. According to the invention, the device 12 has a contact surface 13 which is in contact with at least one outer side 6, 7 of the fabric 2 and which is constructed and arranged in such a way that the contaminants 11 can be transferred from the fabric 2 to the contact surface 13. According to a preferred embodiment of the invention, the contact surface 13 has an effective surface 14 which is larger than that of the fabric 2. The contact surface 13 is normally present in the form of a woven fabric with a fibrous surface, in which the increase in effective surface is brought about by a high slenderness ratio of the fibers.

According to the embodiment of the invention shown in FIG. 1, the contact surface 13 is constructed in the form of a circulating belt 15. In the embodiment of the invention shown in FIG. 2, on the other hand, the contact surface 13 is constructed in the form of a rotatable roll 16 or in the form of a rotatable drum. In an embodiment which is not specifically shown, the circumferential surface of the rotatable roll 16 can be constructed as a contact surface 13 and detachably connected to the actual roll body.

As indicated in the two embodiments of FIGS. 1 and 2, the respective contact surface 13 is assigned a cleaning device 17 and a drying device 20 arranged downstream of the cleaning device 17 in the direction of movement of the contact surface 13. In a particularly simply constructed apparatus, cleaning device and drying device can also be omitted. Furthermore, it is possible to provide only one cleaning device and no drying device, in particular in the case in which the cleaning device operates with a fluid under pressure, such as compressed air, for example, instead of with the aid of water jets under pressure.

In order to make it easier to transfer the contaminants 11 from the fabric 2 to the contact surface 13, the temperature in the contact region between the at least one outer side 6 of the fabric 2 and the contact surface 13 is at least 50° C., preferably at least 80° C.

According to a preferred embodiment of the invention, the device 12 is preferably additionally constructed in such a way that the fabric 2 and the contact surface 13 are preferably pressed against each other in a nip 21 in their contact region. Such an embodiment is illustrated, partly dashed, in FIG. 2. The nip 21 is formed by the small distance between the rotatable roll 16 and a backing roll 22. It is also possible to provide a nip in the exemplary embodiment shown in FIG. 1 and to press fabric and contact surface against each other. In this case, appropriate rolls/backing rolls have to be provided in the contact region between fabric and contact surface, just as in the embodiment according to FIG. 2.

As indicated in FIGS. 1 and 2, the cleaning device 17 is used to remove contaminants 11 from the contact surface 13, for example in the direction of the arrow C, and to feed them to a collecting container, not specifically shown. In particular in the case in which the cleaning device operates on the basis of water jets under pressure, the drying device 20 arranged downstream is used for drying the surface 14 of the contact surface 13 which has come into contact with the water jet. The cleaning device 17 can be a spraying apparatus, for example, the drying device 20 can be a warm or hot air dryer. The drying device 20 therefore prevents the papermachine fabric from being subjected to further moisture as a result of contact with the contact surface.

The enlarged effective surface 14 of the contact surface 13 supplies pick-up locations for the transfer of the sticky contaminants 11. It is also possible for a plurality of apparatuses 1 to be arranged on the papermachine fabric 2. At least one of these apparatuses having a contact surface is provided at the start of the drying section, preferably in the region of the first two groups. The contact surface is, for example, arranged directly at the point where the papermachine fabric leaves the heated cylinder at the start of the return run. The invention is particularly suitable for paper grades with a high content of sticky contaminants, such as board and packaging paper, newsprint and deinked paper.

In the following, the operation of the apparatus according to the invention will be explained in more detail.

The fabric 2 runs in the direction of the arrows A, B around the rolls 3 of large diameter and the rolls 4 of small diameter. It is clear that the fabric 2 is an endless fabric. Likewise, the contact surface 13, for example in the form of an endless belt, runs at least partly parallel to and in the direction of the arrow B of the fabric 2. In this case, at least in the contact region between fabric and contact surface, the contact surface 13 rests closely on the one outer side 6; in FIG. 1 this is the upper side of the fabric 2.

With the preferably simultaneous application of temperature and pressure, the contaminants 11 provided in the region of the outer side 6 of the fabric, in particular sticky or tacky contaminants, can be transferred from the fabric to the contact surface, on account of the significantly higher effective surface of the contact surface as compared with that of the fabric. After the contact region, the individual contaminants 11 are therefore located on the contact surface and no longer on the fabric. The contaminants 11 adhering to the contact surface 13 can be removed from the contact surface with the aid of a cleaning device 17, as indicated by the arrow C. If necessary, a drying device 20 can be arranged downstream of the cleaning device 17, so that a largely dry contact surface can come into contact with the fabric again.

If the contact surface is used up or worn out, it can be replaced by a new contact surface.

An apparatus for cleaning a papermaking machine fabric is therefore provided which operates more economically than conventional apparatuses.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. An apparatus for cleaning a papermachine fabric, comprising a device for removing the contaminants from the fabric, wherein the device has a contact surface which comes into contact with at least an outer side of the fabric and which is constructed and arranged in such a way that the contaminants can be transferred from the fabric to the contact surface, the contact surface having an effective surface which is larger than a fabric surface.

2. The apparatus as claimed in claim 1, wherein the contact surface is a woven fabric with a fibrous surface, in which the increase in the effective surface is brought about by a high slenderness ratio of the fibers.

3. The apparatus as claimed in claim 1, wherein the contact surface is produced from a softer material than the fabric.

4. The apparatus as claimed in claim 1, wherein the contact surface is constructed in one of the form of a circulating belt and in the form of a rotatable roll or drum.

5. The apparatus as claimed in claim 1, wherein the contact surface is treated chemically.

6. The apparatus as claimed in claim 1, wherein the contact surface is assigned a cleaning device in the direction of movement of the contact surface.

7. The apparatus as claimed in claim 1, wherein the temperature in the contact region between the at least one outer side of the fabric and the contact surface is at least 50° C.

8. The apparatus as claimed in claim 1, wherein the device is constructed in such a way that the fabric and the contact surface are pressed against each other in a nip in their contact region.

9. The apparatus as claimed in claim 1, wherein the fabric is a dryer fabric.

10. The apparatus as claimed in claim 1, wherein the contact surface is assigned a cleaning device and a drying device arranged downstream of the cleaning device in the direction of movement of the contact surface.

* * * * *